US005103503A

United States Patent [19]

Fekete, Sr.

[11] Patent Number: 5,103,503

[45] Date of Patent: Apr. 14, 1992

[54] ADJUSTABLE-FIT FLAT TOP HAT

[76] Inventor: Joseph Fekete, Sr., c/o Virginia Garment Co., Inc., P.O. Box 2029, Richmond, Va. 23216

[21] Appl. No.: 643,498

[22] Filed: Jan. 22, 1991

Related U.S. Application Data

[63] Continuation-in-part of Ser. No. 334,986, Apr. 28, 1989, and Ser. No. 548,503, Jul. 2, 1990, Pat. No. 5,025,505.

[51] Int. Cl.[5] ..... A42B 1/02

[52] U.S. Cl. ..... 2/197

[58] Field of Search ..... 2/171.1, 171.4, 171.5, 2/171.6, 171.7, 171.8, 209.3, 209.4, 175, 177, 178, 179, 185 R, 185 C, 190, 191, 195, 197, 199

[56] References Cited

U.S. PATENT DOCUMENTS

| | | | |
|---|---|---|---|
| 1,399,726 | 12/1921 | Werner | 2/197 |
| 1,663,124 | 3/1928 | Fischer | 2/197 |
| 1,805,522 | 5/1931 | Horos | 2/197 |
| 2,106,570 | 1/1938 | Lipton | 2/197 |
| 2,458,275 | 1/1949 | Kriebel | 2/197 |
| 2,556,807 | 6/1951 | Goldman | 2/197 |
| 2,759,191 | 8/1956 | Berg | 2/197 |
| 3,737,918 | 6/1973 | Henschel | 2/197 |
| 3,815,148 | 3/1989 | Satterfield | 2/197 |
| 4,468,815 | 9/1984 | Pellegri | 2/197 |

FOREIGN PATENT DOCUMENTS

| | | | |
|---|---|---|---|
| 567143 | 5/1958 | Belgium | 2/197 |
| 141856 | 8/1930 | Fed. Rep. of Germany | 2/197 |
| 201049 | 7/1923 | United Kingdom | 2/197 |
| 1019556 | 2/1966 | United Kingdom | 2/197 |

*Primary Examiner*—Werner H. Schroeder
*Assistant Examiner*—Diana L. Biefeld
*Attorney, Agent, or Firm*—William T. Hough

[57] ABSTRACT

An adjustable-fit hat having a flatly-formed top with two separate rearwardly positioned spaced-apart reverse foldable rim portions each with intermittently detachable and securable mating mechanism inclusive of a common intermediate anchoring element mounted on an intermediate hat rim portion positioned within a gap between rearwardly positioned opposite ends of the discontinuous hat band, and the hat's flat-top crown being continuous fabric with rearward and opposite-sides fabric, and having a upwardly-extending forward side and front fabric, the upwardly-extending forward fabric being detachably anchored at each of two forward spaced-apart snaps on a forwardly-extending visor.

12 Claims, 2 Drawing Sheets

FIG. 1
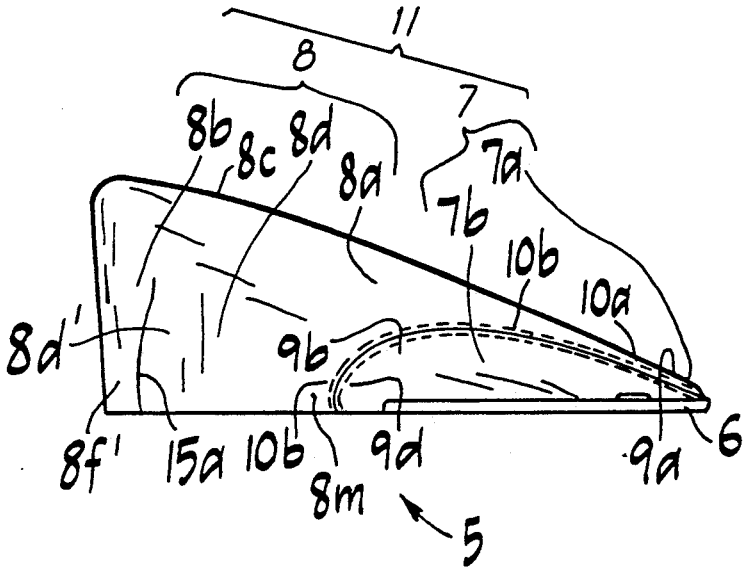
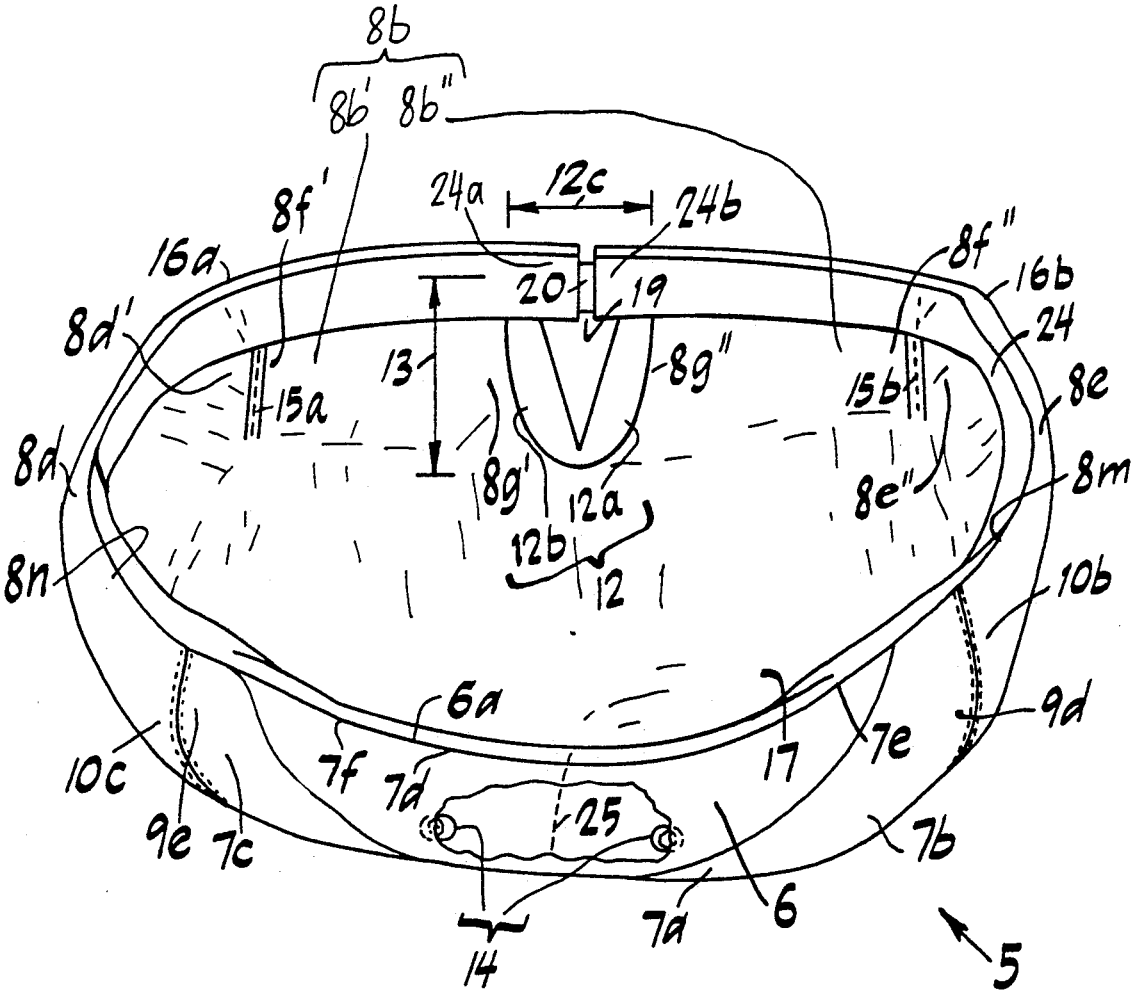
FIG. 2

FIG. 3
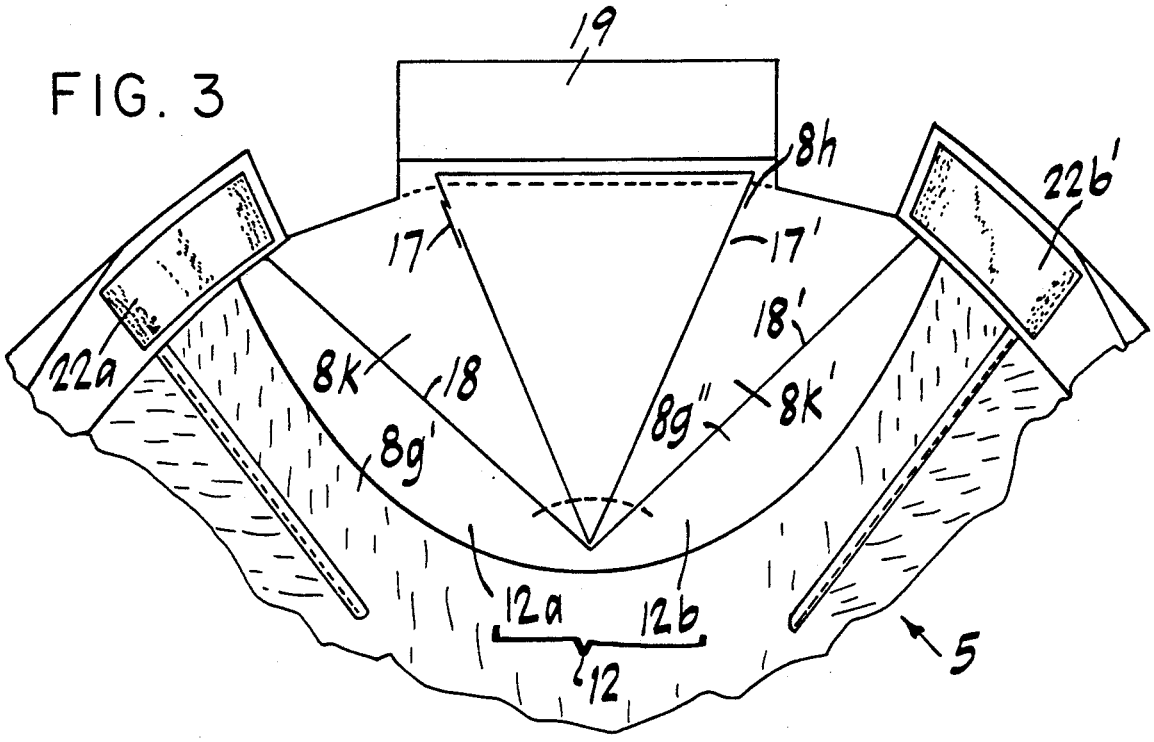
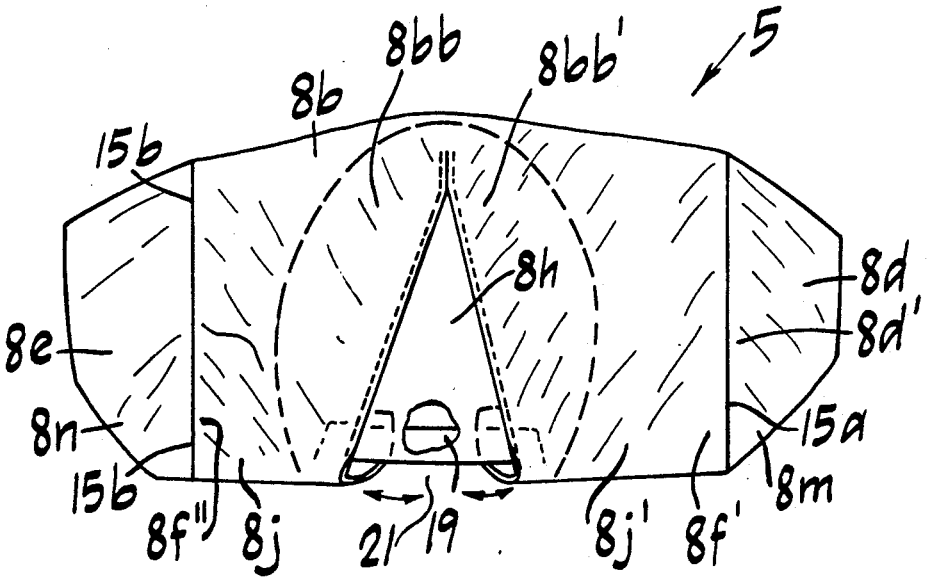
FIG. 4

ADJUSTABLE-FIT FLAT TOP HAT

This is a continuation-in-part of the U.S. patent application Ser. No. 07/334,986 filed Apr. 28, 1989 and of U.S. patent application Ser. No. 07/548,503 filed Jul. 2, 1990 now U.S. Pat. No. 5,025,505 for an adjustable-fit hat. The disclosures of those above-noted parent applications are incorporated by reference into this document as if fully repeated herein.

The present invention is directed to an enhanced related improved different adjustable-fit flat-top hat.

PRIOR ART

In view of the substantial and major differences in the mechanism and structure and advantages of the present invention, as compared to the above-noted invention of the parent application, there is no known relevant prior art. Art of interest considered to be non-analagous and non-teaching, includes the Werner U.S. Pat. No. 1,399,726 to a hat having a one-piece crown with opposite side adjustment elements with rearward spaced-apart upwardly-extending seams, and British patent 1,019,556 to M./s, Michael & Co. Ltd. to a cap having radially-segmented crown with a rearwardly-positioned adjustment mechanism. None of the prior art patents are directed to formally-appearing sport-dress type flat-top hats and problems/difficulties associated therewith and none of the prior art patent have the wrap-around inwardly-foldable anchoring band with spaced-apart attachments to an intermediate anchoring element, and none having the present invention's combination of forward support structure, etc.

BACKGROUND TO THE INVENTION

Prior to the present invention, formally-appearing dressy-type flat-top hats or caps to which the present invention is exclusively directed, have had solely an adjustable fitting of one sort or another, which have heretofore included unsightly open through-space holes extending between an overlapping portion and an overlapped portion of the heretofore discontinuous rim portion of the hat, and with their circularly-shaped top of the crown with its circumscribing supporting sides, back and front, have resulted in uncomforable rigid fits, together with floppy nature resulting from such structural design thereof. As a result thereof, such prior art caps/hats have had a resulting non-fitting wrinkling and gapping-apart of these disconnected parts and have had considerable puckering in an unsightly manner; as a result thereof, the "fit" was not reliably adjustable nor snug. The prior type of adjusted flat-top hat also was not properly aligned with a resulting discomfort as well as unsightly in appearance. Such short comings heretofore reduced and often virtually destroyed any realistic utility and advantages purportedly achieved by the prior art adjustable hat or cap, the worn adjustable hat/cap having failed to holding its flat top and associated supporting rim in secure nor comfortable positions and manners, devoid of properly fitting thereof. For dressy-type sports caps having a turned-under band providing support to and as contrasted to the prior art hats having flimsy rims, there heretofore has not been a neat nor good-fitting relationship for adjustable-fit flat-top hats or caps having a turned-under supporting band because the turned-under band portion was heretofore unstable, such prior art adjustable-fit flat-top being not sewn-together and/or otherwise properly anchored, insofaras the turned-under support band that would overlap the inside of the other spaced-apart end of the discontinuous support band. The aforestated heretofore disadvantages reduced the value of the prior art adjustable flat-top type dress hats because of their failure to properly operate or fit, as well as the resulting unacceptable unsightly appearance above-noted.

Additionally, as to the present inventors recent prior invention of the afore-mentioned parent applications, while those inventions constitutes a marked significant advance in the art as to quality dress-type sports caps and proper fitting thereof in alternative fitting for such adjustable-fit flat-top hat or cap for different head sizes, there never the less remained with those inventions some of the afore-stated problems arising from stress, less-than-optimal cut and distortions in shape resulting from improper fitting due to inherent structure and shape of the caps. As well, the downwardly-extending seam at the normally rearwardly-positioned overlapped rim portions were flimisy in nature, inadequately supporting the crown i.e. normally not a vertical arrangement. These stresses also evidenced themselves in a wrinkling of the flat-top of the crown of the flat-top hat. In arriving at the present invention, other problems were encountered particularly with regard to distortion of the crown having solely a forward supporting rim relative to avoiding unsightly wrickles, improper fit, and avoiding unequal stresses on different portions of the crown.

OBJECTS OF THE INVENTION

Accordingly, objects of the invention include the overcoming and/or avoiding of one or more above-noted difficulties and/or disadvantages of prior-existing adjustable-fit flat-top hats or flat-top caps or flat-top head coverings of those general types discussed-above, and the present objects include the avoiding the newly confronted problems and difficulties encountered in arriving at the present invention disclosed and claimed herein.

Another object is to obtain a novel flat-top dressy sports-type hat devoid of a cut-top round or oval piece having supporting stitching and/or rim, but achieving a taut upper portion slanted forwardly-downwardly from an elevated rearward portion, together with optimal head-fit both on top of the head as well as around the head.

Another object is to obtain a more squared shape of the sides of the crown relative to the back of the crown and hat, to add to improved neatness and taught side panels to result in improved fit.

Another object is to obtain an improved anchoring of the forward portion of the crown, relative to the forward visor thereof, to thereby achieve more uniform and balanced and even downward incline from rearward to forward of the crown's top portion when typically normally fastened to the forward visor.

Another object is to obtain an adjustable-fit flat-top dressy sports-type hat that avoids unsightly puckering of the flat-top and/or a supporting rim, that accompanies unsightly uncomfortable fitting associated with the above-noted unequal stresses encountered in working toward the present invention, and the object being to achieve closely-held neat and comfortable and equalized stresses that constitute a proper fit and acceptably-neat appearance of the over-lapped spaced-apart terminal ends of the discontinuous band and of associated flat-top portion of the adjustable-fit hat as previously discussed-above.

Another more particular object is to obtain a multiple spaced-apart fixed reverse-direction secured portions thereof exhibiting counter-balancing and/or compensating opposite pressures and/or stresses, resulting in equalized stress, together with improved appearance and enhanced utility, such that a close, neat and non-pulling or equalized fit is obtained and experienced by the wearing in any of alternated adjusted fits for different sized heads, for adjustable-fit flat-top hat(s) or cap(s) of a dressy-type.

Another object is to obtain a fixed combination as a single unit concurrently obtaining opposite fixed reverse-direction secured states of the fabric portions at closely-associated points of securing spaced-apart portions of a turned-under hat band together with improved supporting and fit associated therewith as above-discussed.

Another object is to avoid the unsightly through-space opening or hole encountered by band turn-under and adjustable-fit prior art flat-top hats and/or flat-top caps.

Another object is to obtain a modified adjustable-fit flat-top hat or flat-top dress sports-cap, to embody novel structural changes better resisting distortion of shape and/or fit where such distortions normally heretofore occur in adjustable-fit flat-top hats and/or flat-top caps, in order to secure a smooth unwrinked flat-top.

Other objects become apparent from the preceding and following disclosure.

Objects of the invention are obtained by the invention described above and hereinafter.

SUMMARY OF THE INVENTION

Broadly the flat-top type hat combination includes a front visor, a crown and a substantially upright rear support element. The front visor has a visor rearward edge and a visor upper surface. The crown a subcombination of elements, namely a front portion and a top portion. The front portion as a subcombination includes a central front portion and two opposite-end first and second side front portions. The central front portion has a lower front edge and the first side front portion has a first side lower front edge and the second side front portion has a second side lower front edge. The visor rearward edge along the visor rearward edge length is mounted on the lower front edge and the first and second side front edges along the length of the visor's rearward edge. The central front portion has an upper front edge and the first side front portion has a first side upper front edge. The second side front edge has a second side upper front portion. The upper front edge and the first and second side upper front edges extend along a third length. The top portion includes a forward top portion and a rearward crown portion. The forward top portion has a forward top front edge, a forward top first side edge and a forward top second side edge extending along a common fourth length. The upper front edge and the first and second side upper front edges are mounted along the third length on the forward top front edge, the forward top first side edge and the forward top second side edge along the common fourth length. The first side front portion has a first front portion rearward upwardly-extending edge, and the second side front portion has a second front portion rearward upwardly-extending edge. The rearward crown portion includes a rearward top portion, a substantially uprightly-positioned back portion, a first rearward side portion, and a second rearward side portion. The rearward top portion has fabric continuous with each of the back portion, the first rearward side portion, the second rearward side portion and the forward top portion. The back portion has spaced-apart first and second downwardly extending back edges each extending a fifth length from the rearward top portion. The first side portion has a first rearwardly positioned side edge extending the fifth length downwardly from the rearward top portion. The second side portion has a second rearwardly positioned edge extending the fifth length downwardly from the rearward top portion. The first downwardly extending back edge is mounted as a first seam on the first rearwardly positioned side edge along the fifth length, and the second downwardly extending back edge is mounted as a second seam on the second rearwardly positioned side edge along the fifth length. The back portion has opposite back inner and outer faces. The rearward crown portion further includes a composition formed as a substantially rigid fabric. The rigid fabric is mounted on at-least one of the opposite back inner and outer faces. The substantially rigid fabric is of predetermined height dimension sufficiently high (large) that it is to a major degree (extent) to the effect that the forward and rearward top portions are held substantially tautly between the back portion and the forward top edge. The first and second side portions have respective first and second side bottom edges. The first side portion has a first forwardly positioned edge extending from the rearward top portion to the first bottom edge along a sixth length. The second side portion has a second forwardly positioned edge extending from the rearward top portion to the second bottom edge along the sixth length. The first forwardly positioned edge is mounted on the first front portion rearward upwardly-extending edge along the fifth length, and the second forwardly positioned edge is mounted on the second front portion rearward upwardly-extending edge along the fifth length.

In a first preferred embodiment of the above-described broad invention, the flat-top type hat combination, the visor includes an imaginary forward center point on the visor upper surface. The combination further includes a visor fastening structure(s) and mechanism thereof, that intermittently detachably fastens the visor upper surface to the central front portion at each of two spaced-apart locations substantially equally spaced on opposite sides of the imaginary forward center point.

In a second further preferred embodiment of the first preferred embodiment, the upright rear support element is mounted substantially mid-way between the first and second seams. The upright rear support element has an upper-most end. The rigid fabric is of a predetermined height dimension to a major degree greater than the fifth length such that fabric of the back portion and of the rearward top portion are substantially taut between the upper-most end and each of the first and second seams.

In a third further preferred embodiment of the second preferred embodiment, the first seam of the back edge and the first rearwardly positioned side edge are of fabric cuts for the first seam such that fabric is taut between the first front portion rearward upwardly-extending edge and the first seam and is taut between the second front portion rearward upwardly-extending edge. In this embodiment, the rigid fabric has a predetermined minimum width such that, in combination with the above-noted fabric cuts and the first seam, the back bottom edge relative to the first side bottom edge forms and accentuates a first rearward corner. Likewise the second seam of the back edge and the second rearwardly positioned side edge being of a cut for the second seam, and as a result thereof the back bottom edge relative to the second side bottom edge forms and accentuate a second rearward corner such that taken together with the fabric cuts above-noted and with the predetermined minimum width of the rigid fabric, fabric is taut between the second front portion rearward upwardly-extending edge and the second seam.

In a fourth further preferred fourth embodiment on the above-described third preferred embodiment, the back portion includes a central back portion and opposite first and second spaced-apart back portions. The central back portion mounts the upright rear support element. The back portion further includes two spaced-apart reverse-direction first and second foldable portions foldable in opposite lateral directions. The first foldable portion is attached to the central back portion and to the first spaced-apart back portion. The second foldable portion is attached to the central back portion and to the second spaced-apart back portion. The combination additionally includes adjustable attaching structure(s) and mechanism thereof mounted on the uprightly-positioned back portion for intermittently detachable attaching the central back portion separately to each of the opposite first and second spaced-apart back portions. Thereby wearing size of the hat combination is optionally folded to fit alternate sizes of heads.

In a further preferred fifth embodiment on the fourth embodiment, there is included an inwardly-folded under hat band. The hat band is elongated along its longitudinal axis to extend circumscribingly and supportingly along and attached to the back bottom edge, the first and second side bottom edges, the lower front edge and the first and second side lower front edges. The hat band has band opposite ends spaced-apart forming a gap in juxtaposition to the central back portion and to the first and second spaced-apart foldable portions. At least a part of the attaching means is mounted on each of the band opposite ends. Thereby the hat band is adapted to be turned inwardly as an inner supporting band with the inner band face directed outwardly toward the inner rim face.

In a further preferred sixth embodiment on the fifth embodiment, the visor fastening means includes pair of spaced-apart male-female snap combinations adapted to alternately snap and unsnap the front visor from the front portion. This feature is critical for this preferred and optimal embodiment because the result of a spreading-apart of the anchoring (holding forwardly-down) of the front portion is that the resulting stress on the top forward and backward portions is a more uniform distribution such that stress wrinkles are avoided/obviate. Such stress wrinkle otherwise would appear to one degree or another (depending upon other fit features) with such wrinkles heretofore normally angled from top back locations to top front central point(s).

In a further seventh preferred embodiment on the above-described broad invention, there is the same further improvement as the above-described second preferred embodiment.

In a further eighth preferred embodiment on the above-described broad invention, there is the same further improvement as the above-described third preferred embodiment.

In a further ninth preferred embodiment on the above-described broad invention, there is the same further improvement as the above-described fourth preferred embodiment.

In a further tenth preferred embodiment on the above-described broad invention, there is the same further improvement as the above-described fifth preferred embodiment.

In a further eleventh preferred embodiment on the above-described sixth preferred embodiment.

The invention may be better understood by making reference to the drawings of the following figures.

THE FIGURES

FIG. 1 diagrammatically illustrates a preferred embodiment of the invention, in a side view thereof.

FIG. 2 diagrammatically illustrates a front and bottom perspective view of the same preferred embodiment of FIG. 1, with partial cut-away of the front visor to better illustrate the two spaced-apart snaps.

FIG. 3 diagrammatically illustrates for a rearward portion, an enlarged view substantially the same as that of FIG. 2, except in an opened state and showing an anchoring element on the central back portion in a flipped-up state for improved understanding of relationship of various parts and elements to one-another.

FIG. 4 diagrammatically illustrates back view of the same embodiment as that of FIG. 1 with a partial cut-away portion, illustrated in a more spread-apart and unattached state in order to facilitate improved understanding of various parts and their typically normal positions immediately prior to the anchoring thereof in the adjustment of the wearing size prior to wearing the hat.

DETAILED DESCRIPTION

Because all of the drawings of the foregoing FIGS. 1 through 4 illustrate the same optimal preferred embodiment, the same indicia are utilized for the same elements and/or features when shown in more than one drawing and figure. Once described for one drawing or figure, description is not repeated for other figures except in some instances to improve clarity and ease of understanding.

In FIG. 1 there is shown the overall hat as broadly represented by indicia 5. The hat includes a front visor 6 extending horizontally forwardly. The visor has a conventional arcuate front edge and a rearward edge 6*a* extending conventionally along the visor central and opposite sideward and rearward portions thereof. The crown 11 includes several elements, and there is a substantially upright rear support element 12 not viewable in FIG. 1 but shown in each of FIGS. 2 and 3. The crown 11 includes the front portion 7 and a top portion 8. The front portion 7 includes as a subcombination thereof the central front portion 7*a* and the first and second side front portions 7*b* and 7*c*—the second side front portion not being viewable in FIG. 1 but being illustrated in FIG. 2. The central front portion 7*a* has lower front edge 7*d*, the first side front portion 7*b* has the first side lower front edge 7*e*, and the second side front portion 7*c* has the second side lower front edge 7*f*. The lower front edge 7*d* and the first and second side front edges mount the visor 6 along a length of the visor rear edge 6*a*. The central front portion 7*a* has an upper front edge 9*a*, the first side front portion has first side upper front edge 9b and second side front portion has the second side upper front edge 9c—the second side front edge 9c not being shown but being positioned bilaterally the same as the first side front edge 9b. The upper front edge and the first and second side upper front edges extend along a length of the upper front edge 9a and the first and second side upper front edges 9b and 9c. The first and second side front portions 7b and 7c additionally include the first and second front portion rearward upwardly-extending edges 9d and 9e—9e being viewable in FIG. 2.

The top portion 8 includes the forward top portion 8a and the rearward crown portion 8c. The forward top portion 8a has serially along a fourth length a forward top front edge 10a, a forward top first side edge 10b and a forward top second side edge 10c—10c being viewable in FIG. 2. The forward top portion 8a has a forward top first front edge 10a and forward top first and second side edges 10b and 10c—10c not being shown but being bilaterally positioned the same as 10b. The edges 10a, 10b and 10c serially are mounted on the forward top front edge and the forward top first and second side edges along the third length.

The rearward crown portion 8c includes the rearward top portion 8b, the uprightly-positioned back portion 8b, and the first and second rearward side portions 8d and 8e. The rearward top portion 8c has continuous unbroken fabric with the fabrics of the rearward back portion 8b and the first and second rearward side portions 8d and 8e.

As illustrated in FIG. 4, the back portion 8b has spaced-apart first and second downwardly extending back edges each extending a downward fifth length. The first downwardly extending back edge 8f' is mounted as a first seam 15a on the first rearwardly positioned side edge 8d' along the fifth length, and the second downwardly extending edge 8f'' is mounted as a second seam 15b on the second rearwardly positioned side edge 8e'' along the fifth length.

The FIG. 4 back portion 8b has FIG. 3 back inner faces 8a' and 8g'' and opposite thereto back outer faces 8bb and 8bb'. The substantially rigid fabric 12 includes opposite joined sections 12a and 12b shown in FIGS. 2 and 3, as mounted on the respective spaced-apart inner faces 8g' and 8g''. The substantially rigid fabric 12 and sections 12a and 12b thereof are of the predetermined height 13.

The first and second side portions 8d and 8e have first and second side bottom edges nos. 8m and 8n. The first side portion 8d has first forwardly positioned edge 10b, and the second side portion 8e has second forwardly positioned edge 10c. The first forwardly positioned edge 10b is mounted on the first front portion rearward upwardly-extending edge 9d along the fifth length, and the second forwardly positioned edge 10c is mounted on the first front portion rearward upwardly-extending edge 10c.

FIG. 1 in the partial cut-away of the visor 6, illustrates the two spaced-apart male-female snaps 14 spaced equally on opposite sides of the imaginary mid-point or center point 25 of the visor 6.

As is illustrated in FIG. 2, the upright rear support element is mounted substantially mid-way between the first and second seams between seams 15a and 15b. The rigid fabric 12 of major height typically as shown and the sections 12a and 12b thereof have sufficient width 12c, in combination with the above-noted fabric cuts, as to form and accentuate the first and second rearward corner 16a and 16b. Fabric is thereby taut between the second front portion rearward upwardly-extending edge and the second seam.

The back portion 8b has the central back portion 8h and spaced-apart back portions 8j and 8j' shown in FIG. 4 connected to the central back portion 8h by the intermediate spaced-apart first and second foldable portions 8k and 8k'. The foldable portions are non-rigid material such as flexible fabric that is foldable at any of various locations between attaching points 17 and 18 and between attaching points 17' and 18'. In the optimal preferred embodiment, the attaching structure for intermittently adjusting wearing size, includes the fastening member 19 of FIG. 3 (and shown in the partial cut-away of FIG. 4) having a surface 20 of FIG. 2 that is one fabric inclusive of one of tiny hooks or tiny loops, and mounted on opposite sides of the gap 21 of FIG. 4 and having spaced-apart members 22a and 22b' each having surfaces each of which is a remaining one of the tiny hooks or tiny loops, such that the fastening member 19 at any of various locations thereon is attachable to each of the members 22a and 22b' at any of various locations thereof when folded in the positions shown in FIG. 4.

The hat conventional inwardly folded hat-band 24 having opposite spaced-apart ends 24a and 24b of FIG. 2, which in this embodiment mounts the attaching members 22a and 22b as shown in FIG. 3, is shown with the band ends 24a and 24b flipped-up for purposes of illustration in FIG. 3. Greater detail as to corresponding structure is set-forth in the above-noted parent applications.

The invention includes variations and/or modifications and/or substitution of equivalents to the extent obvious to a person of ordinary skill in this art.

I claim:

1. A flat-top type hat comprising as a combination: a front visor, a separate crown and a separate substantially upright rear support element; said front visor having a visor rearward edge and a visor upper surface; said crown including a front portion, and a separate top portion; said front portion including a central front portion and continuous therewith two opposite-end first and second laterally-extending side front portions; said central front portion having continuous fabric material having a lower front edge and said first side front portion having a first side lower front edge and said second side front portion having a second side lower front edge; said visor rearward edge having a visor rearward edge length, said lower front edge and said first and second side front edges having a common front portion rearward edge length; said visor rearward edge along said visor rearward edge length being mounted on said lower front edge and said first and second side front edges along said common front portion rearward edge length; said central front portion having an upper front edge and said first side front portion having continuous therewith a first side upper front edge, and said second side front edge having a second side upper front portion, said upper front edge and said first and second side upper front edges extending along a third length and being of fabric continuous with said fabric material of said first upper front edge; said top portion including a forward top portion and a rearward crown portion; said forward top portion having a forward top front edge, a forward top first side edge and a forward top second side edge extending along a common fourth length; said upper front edge and said first and second side upper front edges being mounted along said third length on said forward top front edge, said forward top first side edge and said forward top second side edge along said common fourth length; said first side front portion having a first front portion rearward upwardly-extending edge, and said second side front portion having a second front portion rearward upwardly-extending edge; said rearward crown portion including a rearward top portion, a substantially uprightly-positioned back portion, a first rearward substantially upright side portion, and a second rearward substantially upright side portion; said rearward top portion having fabric continuous with each of said back portion, said first rearward side portion, said second rearward side portion and said forward top portion; said back portion having spaced-apart first and second downwardly extending back edges each extending a fifth length from said rearward top portion, and said first side portion having a first rearwardly positioned side edge extending said fifth length downwardly from said rearward top portion, and said second side portion having a second rearwardly positioned edge extending said fifth length downwardly from said rearward top portion, said first downwardly extending back edge being mounted as a first seam on said first rearwardly positioned side edge along said fifth length, and said second downwardly extending back edge being mounted as a second seam on said second rearwardly positioned side edge along said fifth length; said back portion having opposite back inner and outer faces; and said rearward crown portion further including a composition formed as a substantially rigid fabric, said substantially rigid fabric being of a predetermined height dimension, and said rigid fabric being mounted on at-least one of said opposite back inner and outer faces, said predetermined height dimension being of sufficient said major degree such that said forward and rearward top portions are held substantially tautly between said back portion and said forward top edge; said back portion having a back bottom, said first side portion having a first side bottom edge, and said second side portion having a second side bottom edge; said first side portion having a first forwardly positioned edge extending from said rearward top portion to said first bottom edge along a sixth length, and said second side portion having a second forwardly positioned edge extending from said rearward top portion to said second bottom edge along said sixth length, said first forwardly positioned edge being mounted on said first front portion rearward upwardly-extending edge, and said second forwardly positioned edge being mounted on said second front portion rearward upwardly-extending edge.

2. A flat-top type hat of claim 1, in which said visor includes an imaginary forward center point on said visor upper surface, and including visor fastening means intermittently detachably fastening said visor upper surface to said central front portion at each of two spaced-apart locations substantially equally spaced on opposite sides of said imaginary forward center point.

3. A flat-top type hat of claim 2, in which said upright rear support element is mounted substantially mid-way between said first and second seams and in which said upright rear support element has an upper-most end, in which said rigid fabric is of a predetermined height dimension to a major degree greater than said fifth length such that fabric of said back portion and of said rearward top portion are substantially taut between said upper-most end and each of said first and second seams.

4. A flat-top type hat of claim 3, in which said first seam of said back edge and said first rearwardly positioned side edge are of fabric cuts for said first seam such that fabric is taut between said first front portion rearward upwardly-extending edge and said first seam and is taut between said second front portion rearward upwardly-extending edge whereby said back bottom edge relative to said first side bottom edge forms and accentuates a first rearward corner, and said second seam of said back edge and said second rearwardly positioned side edge being of a cut for said second seam such that said back bottom edge relative to said second side bottom edge forms and accentuate a second rearward corner such that fabric is taut between said second front portion rearward upwardly-extending edge and said second seam.

5. A flat-top type hat of claim 4, in which said back portion includes a central back portion and opposite first and second spaced-apart back portions, said central back portion mounting said upright rear support element, and said back portion further including two spaced-apart reverse-direction first and second foldable portions foldable in opposite lateral directions, the first foldable portion being attached to said central back portion and to the first spaced-apart back portion, the second foldable portion being attached to said central back portion and to the second spaced-apart back portion, and including adjustable attaching means mounted on said uprightly-positioned back portion for intermittently detachable attaching said central back portion separately to each of said opposite first and second spaced-apart back portions whereby wearing size of the combination may is optionally folded to fit alternate sizes of heads.

6. A flat-top type hat of claim 5, including an inwardly-folded under hat band, the hat band are elongated along its respective longitudinal axis to extend circumscribingly and supportingly along and attached to said back bottom edge, said first and second side bottom edges, said lower front edge and said first and second side lower front edges, the hat band being having band opposite ends spaced-apart forming a gap in juxtaposition to said central back portion and to said first and second spaced-apart foldable portions, at least a part of said attaching means being mounted on each of said band opposite ends whereby the hat band is adapted to be turned inwardly as an inner supporting band with the inner band face directed outwardly toward the inner rim face.

7. A flat-top type hat of claim 6, in which said visor fastening means includes pair of spaced-apart male-female snap combinations adapted to alternately snap and unsnap the front visor from the front portion.

8. A flat-top type hat of claim 2, in which said visor fastening means includes pair of spaced-apart male-female snap combinations adapted to alternately snap and unsnap the front visor from the front portion.

9. A flat-top type hat of claim 1, in which said upright rear support element is mounted substantially mid-way between said first and second seams and in which said upright rear support element has an upper-most end, in which said rigid fabric is of a predetermined height dimension to a major degree greater than said fifth length such that fabric of said back portion and of said rearward top portion are substantially taut between said upper-most end and each of said first and second seams.

10. A flat-top type hat of claim 1, in which said first seam of said back edge and said first rearwardly positioned side edge are of fabric cuts for said first seam such that fabric is taut between said first front portion rearward upwardly-extending edge and said first seam and is taut between said second front portion rearward upwardly-extending edge whereby said back bottom edge relative to said first side bottom edge forms and accentuates a first rearward corner, and said second seam of said back edge and said second rearwardly positioned side edge being of a cut for said second seam such that said back bottom edge relative to said second side bottom edge forms and accentuate a second rearward corner such that fabric is taut between said second front portion rearward upwardly-extending edge and said second seam.

11. A flat-top type hat of claim 1, in which said back portion includes a central back portion and opposite first and second spaced-apart back portions, said central back portion mounting said upright rear support element, and said back portion further including two spaced-apart reverse-direction first and second foldable portions foldable in opposite lateral directions, the first foldable portion being attached to said central back portion and to the first spaced-apart back portion, the second foldable portion being attached to said central back portion and to the second spaced-apart back portion, and including adjustable attaching means mounted on said uprightly-positioned back portion for intermittently detachable attaching said central back portion separately to each of said opposite first and second spaced-apart back portions whereby wearing size of the combination may is optionally folded to fit alternate sizes of heads.

12. A flat-top type hat of claim 1, including an inwardly-folded under hat band, the hat band are elongated along its respective longitudinal axis to extend circumscribingly and supportingly along and attached to said back bottom edge, said first and second side bottom edges, said lower front edge and said first and second side lower front edges, the hat band being having band opposite ends spaced-apart forming a gap in juxtaposition to said central back portion and to said first and second spaced-apart foldable portions, at least a part of said attaching means being mounted on each of said band opposite ends whereby the hat band is adapted to be turned inwardly as an inner supporting band with the inner band face directed outwardly toward the inner rim face.

* * * * *